US006561735B1

(12) United States Patent
Blandford et al.

(10) Patent No.: US 6,561,735 B1
(45) Date of Patent: May 13, 2003

(54) WELL RISER LATERAL RESTRAINT AND INSTALLATION SYSTEM FOR OFFSHORE PLATFORM

(75) Inventors: Joseph W. Blandford, Houston, TX (US); Kent B. Davies, Houston, TX (US); Stephen E. Kibbee, Katy, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 09/743,294

(22) PCT Filed: Jul. 6, 1999

(86) PCT No.: PCT/US99/15140

§ 371 (c)(1),
(2), (4) Date: Jan. 5, 2001

(87) PCT Pub. No.: WO00/01894

PCT Pub. Date: Jan. 13, 2000

Related U.S. Application Data

(60) Provisional application No. 60/091,858, filed on Jul. 6, 1998.

(51) Int. Cl.[7] ..... E02D 5/62; E21B 7/12; E21B 15/02

(52) U.S. Cl. ..... 405/224.2; 405/195.1; 166/350; 166/359; 166/367; 175/7

(58) Field of Search ..... 405/195.1, 224, 405/224.2, 224.4, 166, 168.1–168.4, 169; 166/350, 359, 367, 340, 338, 368; 175/5–7

(56) References Cited

U.S. PATENT DOCUMENTS 3,817,325 A * 6/1974 Mott et al. ..... 175/7 X
4,142,584 A * 3/1979 Brewer et al. ..... 166/359
4,222,341 A * 9/1980 Larsen et al. ..... 175/5 X
4,286,665 A * 9/1981 Walker ..... 166/339
4,478,287 A * 10/1984 Hynes et al. ..... 166/359 X
4,557,332 A * 12/1985 Denison et al. ..... 166/359 X
4,615,646 A * 10/1986 Langner ..... 405/169
4,702,321 A * 10/1987 Horton ..... 166/358 X
4,867,605 A * 9/1989 Myers et al. ..... 405/224 X
4,906,139 A * 3/1990 Chiu et al. ..... 405/224
5,558,467 A * 9/1996 Horton ..... 405/195.1
5,590,982 A * 1/1997 Huete ..... 405/224 X
5,706,897 A * 1/1998 Horton, III ..... 166/359
5,846,028 A * 12/1998 Thory ..... 405/195.1
5,964,550 A * 10/1999 Blandford et al. ..... 405/224
6,027,286 A * 2/2000 Pollack ..... 405/195.1
6,161,620 A * 12/2000 Cox et al. ..... 166/367
6,176,646 B1 * 1/2001 Finn et al. ..... 405/224.2
6,206,614 B1 * 3/2001 Blevins et al. ..... 405/224
6,309,141 B1 * 10/2001 Cox et al. ..... 405/224

FOREIGN PATENT DOCUMENTS

GB 2152747 * 8/1985 ..... 405/195.1

* cited by examiner

*Primary Examiner*—Jong-Suk (James) Lee
(74) *Attorney, Agent, or Firm*—Nick A. Nichols, Jr.

(57) ABSTRACT

A floating platform system supports one or more decks (14) above the water surface for accommodating equipment to process oil, gas and water recovered from a subsea hydrocarbon formation. The platform is secured to the seabed by one or more tendoms (17). A central column (12) of the platform includes a moonpool (19) extending axially through the central column (12). The moonpool (19) is open at the lower and upper ends thereof. Riser lateral restraint members (32) are supported within the moonpool (19) for laterally restraining risers (16) disposed in the moonpool (19) and minimizing riser spacing and riser deflection.

10 Claims, 10 Drawing Sheets

18
12
38
36
34
29
32
33
30
19

12
18
16
44
40
42
38
33
38
34
32
30
19

18
12
38
16
32
40
34
30
19

18
12
16
32
40
34
30
38
19

WELL RISER LATERAL RESTRAINT AND INSTALLATION SYSTEM FOR OFFSHORE PLATFORM

This appln. is a 371 of PCT/US99/15140 filed Jul. 6, 1999 which claims the benefit of Prov. No. 60/091,858 filed Jul. 6, 1998.

BACKGROUND OF THE DISCLOSURE

The present invention relates generally to floating platform systems for testing and producing hydrocarbon formations found in deep (600–10,000 feet) offshore waters, and in deeper or shallower water depths where appropriate, particularly to a method and system for economically producing relatively small hydrocarbon reserves in mid-range to deep water depths which currently are not economical to produce utilizing conventional technology.

Commercial exploration for oil and gas deposits in U.S. domestic waters, principally the Gulf of Mexico, is moving to deeper waters (over 600 feet) as shallow water reserves are being depleted. Companies must discover large oil and gas fields to justify the large capital expenditure needed to establish commercial production in these water depths. The value of these reserves is further discounted by the long time required to begin production using current high cost and long lead-time designs. As a result, many smaller or "lower tier" offshore fields are deemed to be uneconomical to produce. The economics of these small fields in the mid-range and deep water depths can be significantly enhanced by improving and lowering the capital expenditure of methods and apparatus to produce hydrocarbons from them. It will also have the additional benefit of adding proven reserves to the nation's shrinking oil and gas reserves asset base.

In shallow water depths (up to about 300 feet), in regions where other oil and gas production operations have been established, successful exploration wells drilled by jack-up drilling units are routinely completed and produced. Such completion is often economically attractive because light weight bottom founded structures can be installed to support the surface-piercing conductor pipe left by the jack-up drilling unit and the production equipment and decks installed above the water line, which are used to process the oil and gas produced from the wells. Moreover, in a region where production operations have already been established, available pipeline capacities are relatively close, making pipeline hook-ups economically viable. Furthermore, since platform supported wells in shallow water can be drilled or worked over (maintained) by jack-up rigs, shallow water platforms are not usually designed to support heavy drilling equipment on their decks. This enables the platform designer to make the shallow water platform light weight and low cost, so that smaller reservoirs may be made commercially feasible to produce.

Significant hydrocarbon discoveries in water depths over about 300 feet are typically exploited by means of centralized drilling and production operations that achieve economies of scale. For example, production and testing systems in deep waters in the past have included converting Mobile Offshore Drilling Units ("MODU's"). into production or testing platforms by installing oil and gas processing equipment on their decks. A MODU is not economically possible for early production of less prolific wells due to its high daily cost. Similarly, early converted tanker production systems, heretofore used because they were plentiful and cheap, are also not economical for less prolific wells. In addition, environmental concerns (particularly in the U.S. Gulf of Mexico) have reduced the desirability of using tankers for production facilities instead of platforms. Tankers are difficult to keep on station during a storm, and there is always a pollution risk, in addition to the danger of having fired equipment on the deck of a ship that is full of oil or gas liquids.

TLP's have attracted considerable attention in recent years. A conventional TLP consists of a four column semi-submersible floating substructure, multiple vertical tendons attached at each corner, tendon anchors to the seabed, and well risers. A variation of the conventional TLP, a single leg TLP, has four columns and a single tendon/well riser assembly. The conventional TLP deck is supported by four columns that pierce the water plane. These types of TLP's typically bring well(s) to the surface for completion and are meant to support from 20 to 60 wells at a single surface location. In a mono-column TLP, risers for subsea wells can be hung on the outer surface of the column. In some designs where the TLP column is provided with a moonpool, the well risers are hung about the periphery of the moonpool. In U.S. Pat. No. 5,330,293, a platform is disclosed having a large moonpool. The well risers are horizontally secured in stanchions located about the periphery of the moonpool. The well risers are permitted to move vertically but not horizontally because of the restraint of the stanchions.

There continues to be a need however for improved platform and drilling systems, particularly for use in deep waters. As the water depth increases, the greater the load the platform must support. Thus, larger platform hulls are required to support the increased load and thereby increasing the cost of the platform. Another factor adding to the cost of a platform is riser spacing. If greater riser spacing is required, as for example to compensate for riser deflection in high current environments, platform size and cost may be driven by riser spacing rather than payload. Thus, minimizing riser spacing requirements would be highly desirable for reducing the size of the platform and reducing the platform cost.

It is therefore an object of the present invention to provide a floating platform system which suppresses substantially all vertical motions. A single large column provides buoyancy more efficiently than multiple columns with a small water plane area.

It is another object of the invention to provide a floating platform system having a central column wherein top-tensioned vertical production and drilling risers traverse the platform hull in a central moonpool.

It is yet another object of the invention to provide a floating platform system wherein minimum the well riser spacing requirements by providing lateral riser restraint and a lowering or pull-down system for running risers.

SUMMARY OF THE INVENTION

The present invention provides a floating platform for producing and processing well fluids produced from subsea hydrocarbon formations. The platform supports one or more decks above the water surface for accommodating equipment to process oil, gas, and water recovered from the subsea hydrocarbon formation. In a preferred embodiment, the platform includes a central column substantially located below the water surface and in the wave zone. The upper portion of the central column extends above the water surface. The central column includes a base structure comprising three or more pontoons extending radially outwardly from the bottom of the central column. The platform is anchored to the seabed by one or more tendons secured to the base of the central column. A moonpool open at the upper and lower ends of the central column extends axially through the central column. A riser lateral restraint system is supported within the moonpool.

BRIEF DESCRIPTION OF THE DRAWINGS

So that the manner in which the above recited features, advantages and objects of the present invention are attained can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
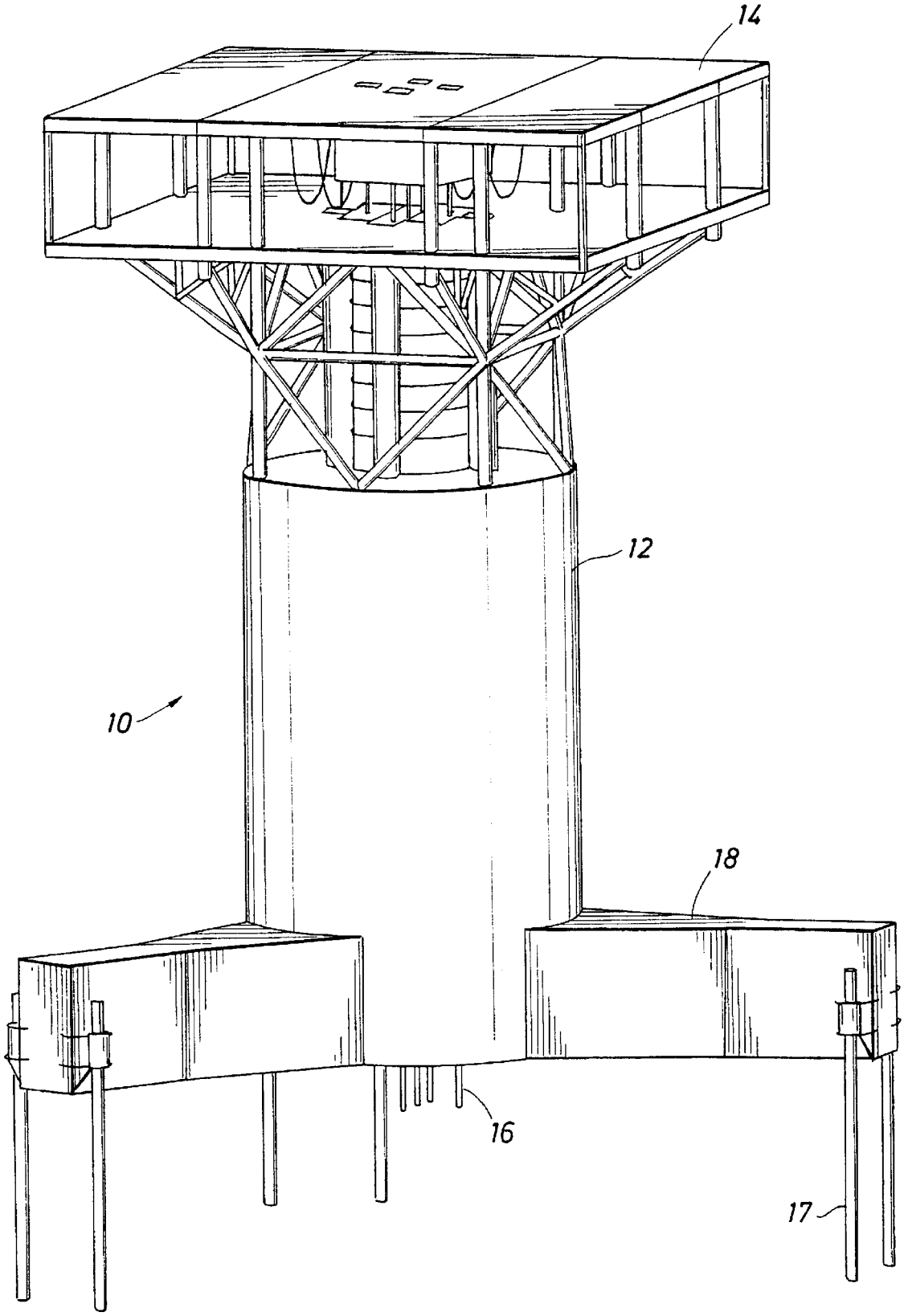
FIG. 1 is a perspective view of the floating platform system of the invention.

Referring first to FIG. 1, the tension leg production platform of the invention is generally identified by the reference numeral 10. The production platform 10 includes a hull 12 which provides positive buoyancy and vertical support for the entire production platform 10 and supports a rig and production deck 14 which is large enough to accommodate the equipment necessary to fully or partially control and process the oil, gas and water produced from the subsea reservoir, and to support a drilling, work over or completion rig or a wireline unit.

The hull 12 comprises a single surface piercing column extending upward from a base node having pontoons 18 extending radially outward from the base node. The hull 12 provides sufficient buoyancy to support the deck 14, drilling and/or completion units, production facilities, production and drilling risers 16, and has sufficient excess buoyancy to develop the design tendon pre-tension. The production platform 10 is anchored to the seabed by tendons 17 which are secured to the pontoons 18 at the upper ends thereof and to foundation piles (not shown in the drawings) embedded in the seabed at the lower ends thereof.

The hull 12 is of stiffened plate construction. In the preferred embodiment of FIG. 1, the pontoons 18 extend radially outward from the base node of the hull 12 and are equally spaced from each other. It is understood however that fewer or a greater number of pontoons 18 may be incorporated in the design of the hull 12. It is also understood that the design of the hull 12 may not include pontoons. In such hull design, the tendons 17 are connected directly to the hull 12.

The configuration of the hull 12 is designed for ease of fabrication and installation. In addition, both the hull 12 and the pontoons 18 are compartmentalized for limiting the effects of accidental damage. The hull 12 may be a single columnar structure or formed of a plurality of stacked buoyancy tanks welded one on the other. The substantially cylindrical structure of the hull 12 shown in FIG. 1 includes inner and outer walls defining ballast chambers therebetween. The assembled hull 12 includes an axial passage or central moonpool 19 extending therethrough, which moonpool 19 is open at the lower and upper ends thereof.

Figure 2:
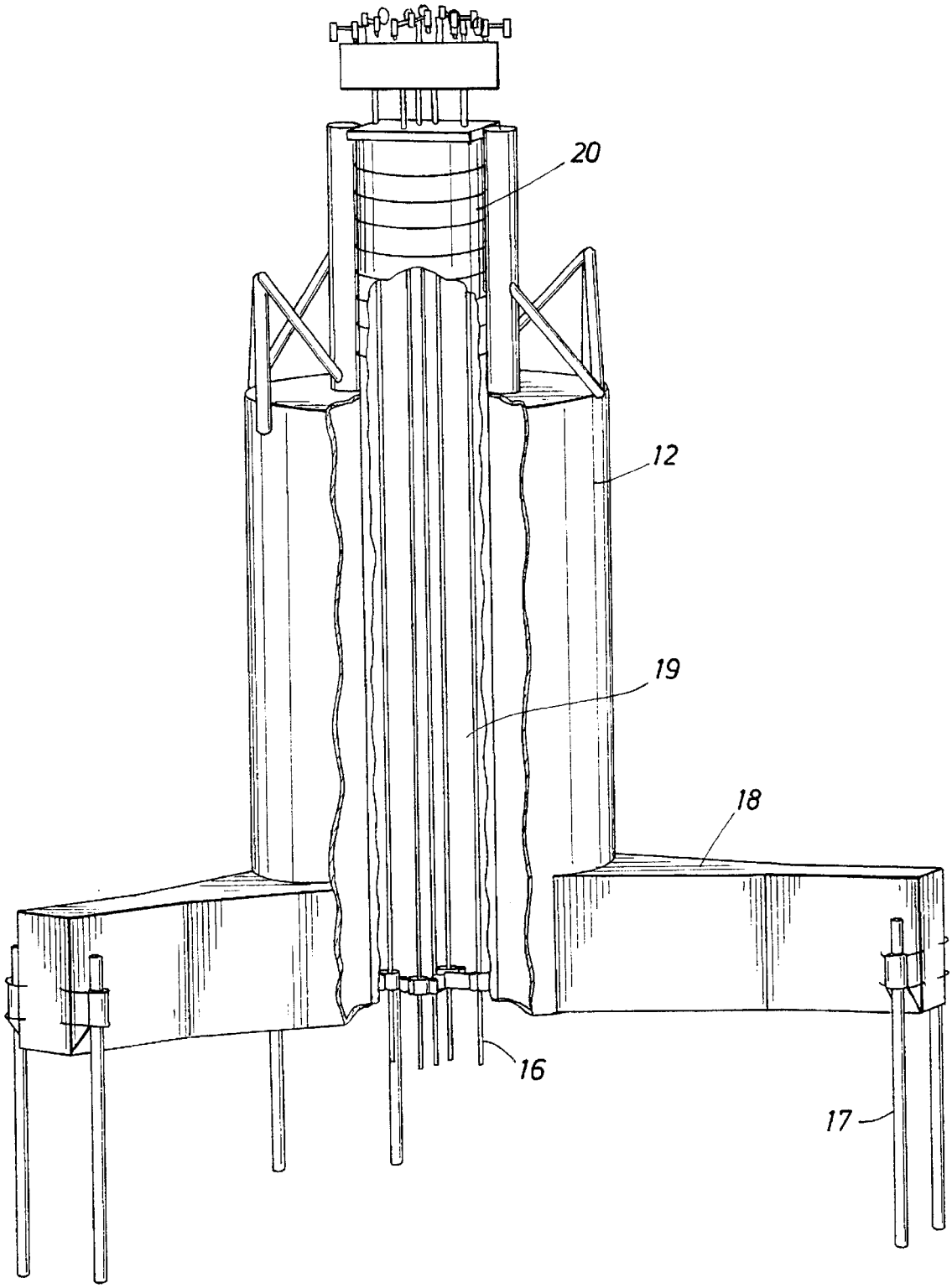
FIG. 2 is a perspective partially broken away view of the hull and base of the invention illustrating top-tensioned production and drilling risers extending through the moonpool of the central column of the invention.

Referring now to FIG. 2, an upstanding cylindrical housing 20 is shown extending upwardly from the top of the hull 12, providing access to the moonpool 19 from topside. The lower end of the housing 20 circumscribes and encloses the open upper end of the moonpool 19. Production, workover and drilling risers 16 vertically traverse the hull 12 in the moonpool 19 as shown in FIG. 2. The risers 16 are connected end to end to form a riser string which is maintained in a tensioned condition by tensioners 22 secured to the upper end of the riser string.

Figure 3:
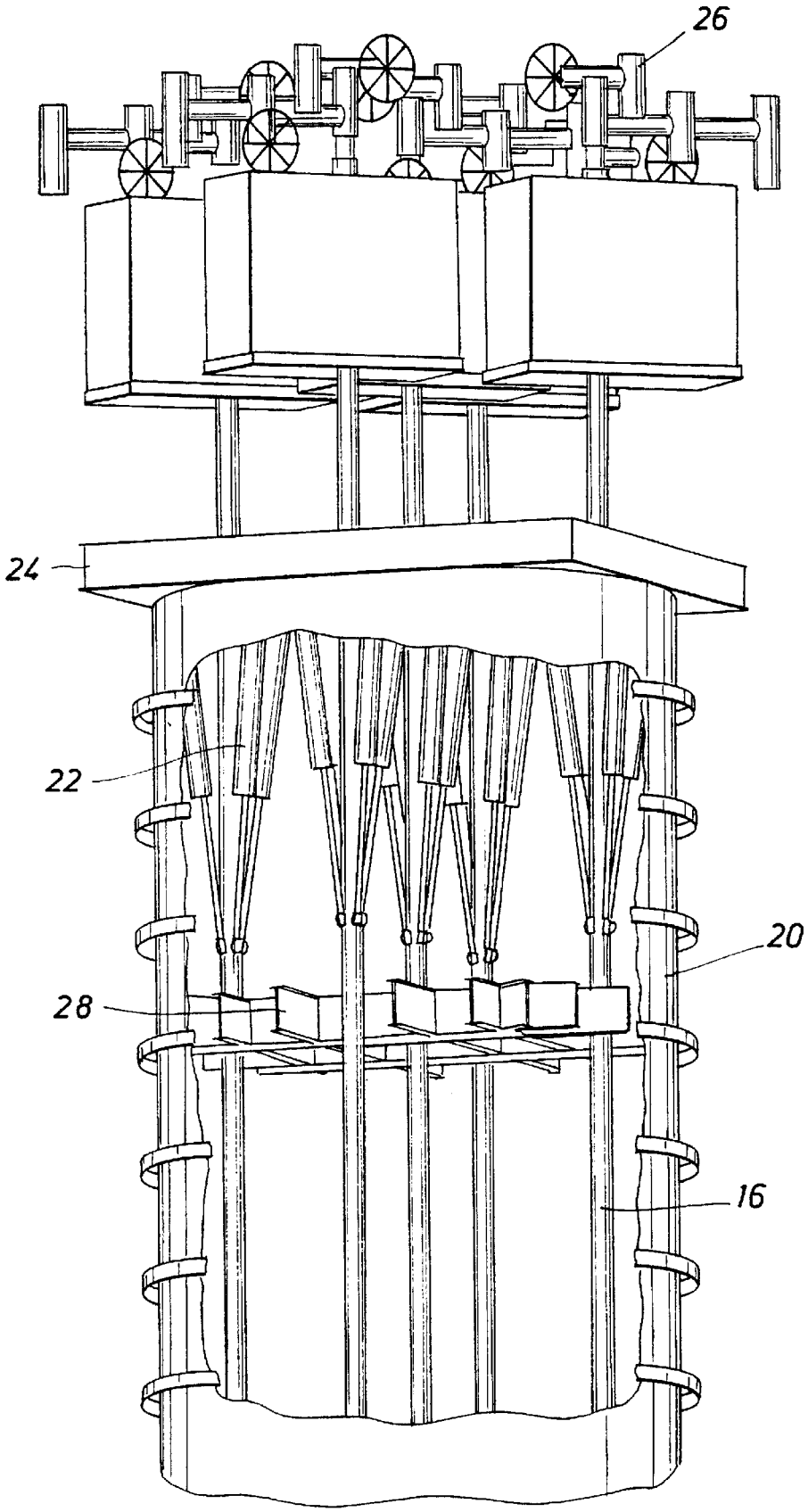
FIG. 3 is a perspective partially broken away view of the central column of the invention illustrating the riser tensioners and production trees mounted on the platform deck.

Top-tensioning of the risers 16 is more fully detailed in FIG. 3. The risers 16 are tensioned by the tensioners 22 in a known manner. Hydraulic tensioners 22 of the type shown in FIG. 3 are typically connected to the bottom of the tree deck 24 at one end and to the risers 16 at the opposite end thereof. The risers 16 extend through the tree deck 24 and are connected to wellhead trees 26 mounted thereon. In the embodiment of FIG. 3, five well slots are provided through the work deck 28, for illustrative purposes, providing center-to-center well riser spacing. It is understood however that the number of risers 16 is not limited to the configuration shown in FIG. 3, but rather by the platform design criteria. Other types of riser tensioners are also possible, including suspending the risers from the deck under tension. The risers 16 shown in FIG. 1 are supported by the tensioners 22 at the tree deck 24 and are laterally restrained at the keel of the hull 12 by riser restraint guides 32 described in greater detail hereinafter.

Figure 4:
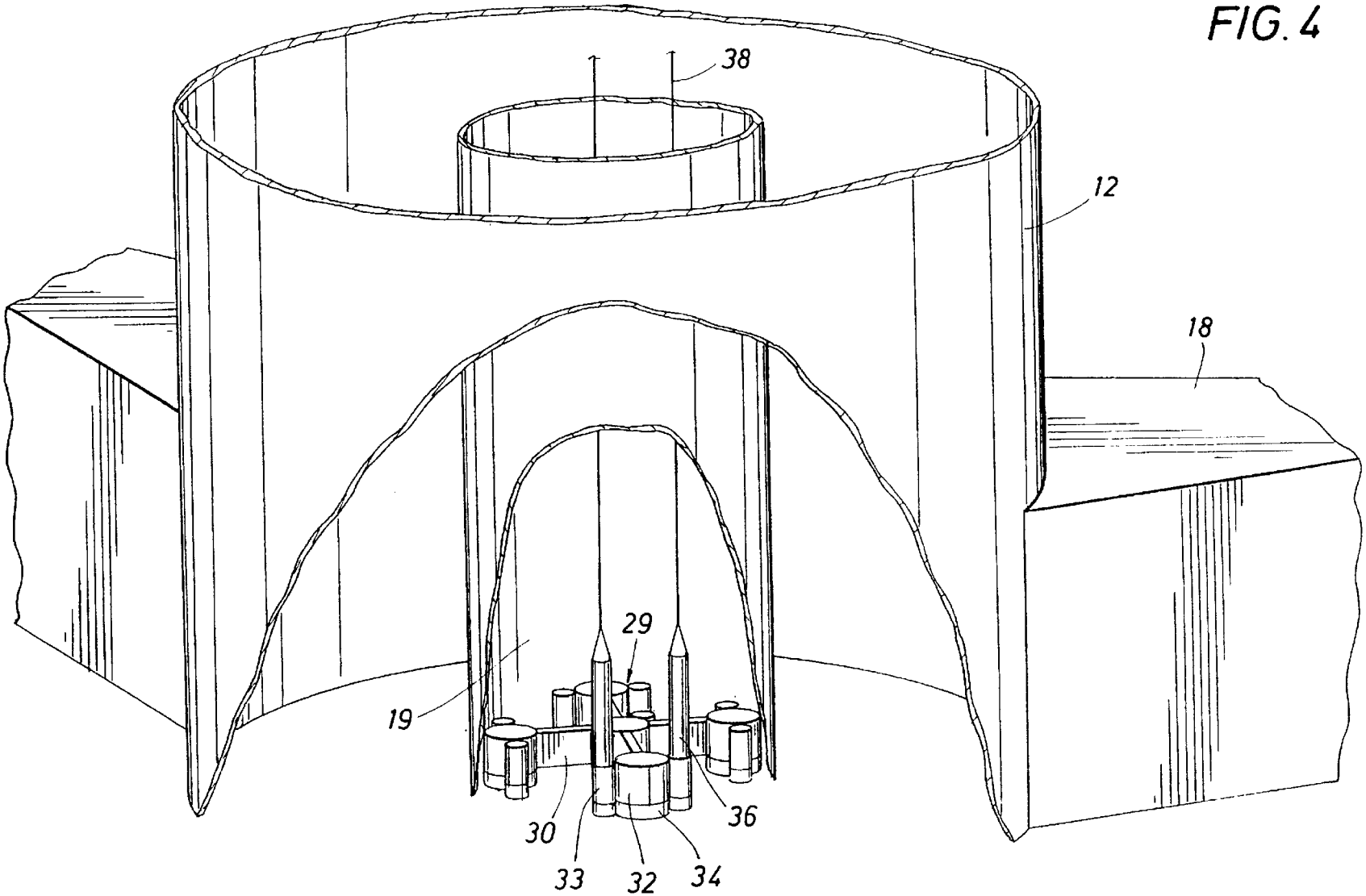
FIGS. 4–9 are perspective partially broken away views of the central column of the invention illustrating the riser running sequence employing the riser lateral restraint system of the invention.

Referring now to FIGS. 4–9, the riser restraint guides 32 are secured in the moonpool 19 at the lower end of the hull 12. The riser guides 32 are assembled in an array which extends across the moonpool 19 perpendicular to the vertical axis of the hull 12. Frame members 30 interconnect the riser restraint guides 32 which are spaced substantially equidistant from each other across the moonpool 19 at the lower end of the hull 12 for restraining lateral movement of the risers 16 extending through the moonpool 19. The riser restraint guides 32 are mounted across the moonpool 19 by welding or otherwise securing the peripheral riser guides 32 to the inner wall of the hull 12 as shown in FIG. 4. In the riser guide array shown in FIG. 4, the frame members 30 connect the central riser guide 32 to the peripheral guides 32. In a like manner, a smaller or larger array of guides 32 may be mounted across the moonpool 19 to accommodate a lesser or greater number of risers 16 extending through the moonpool 19.

The riser guides 32 are open at each end thereof and define an axial passage extending through the riser guides 32. External guide tubes 33 are mounted on opposite sides of each of the riser guides 32. The guide tubes 33 are welded or otherwise secured to the riser guides 32, or may be integrally formed therewith. Lower guide frames 34 are releasably connected to the lower ends of the riser guides 32. The guide frames 34 include openings extending therethrough which upon connection of the guide frames 34 to the riser guides 32 align with the lower open ends of the riser guides 32 and guide tubes 33.

The present invention minimizes riser spacing by utilizing the riser guides 32 to minimize the spacing of the risers 16 extending through the moonpool 19 of the hull 12. In addition, guide posts 36 and guide lines 38 are employed to guide the risers 16 downward for engagement with the wellhead, thereby further minimizing riser deflection.

Figure 5:
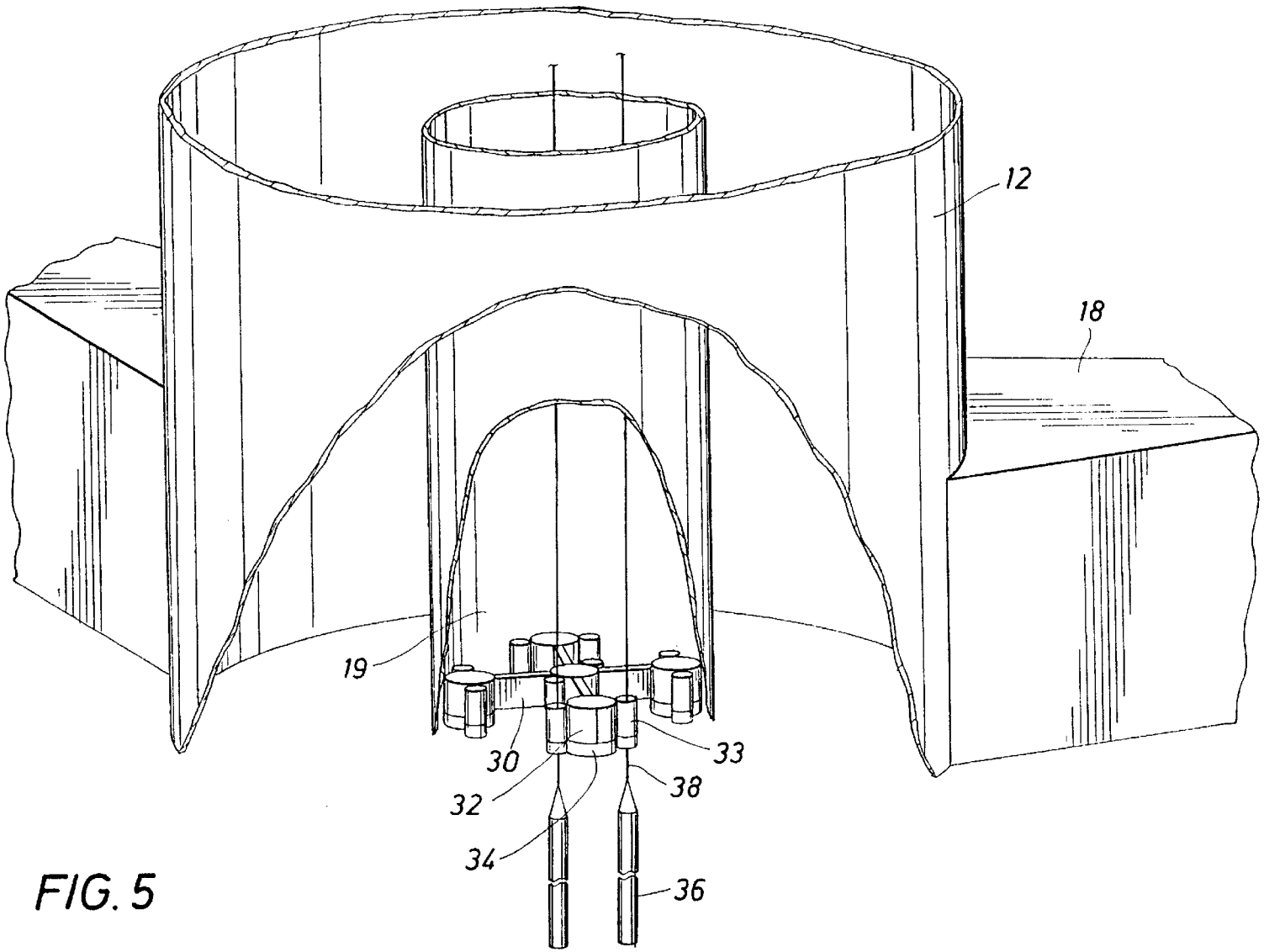
Figure 7:
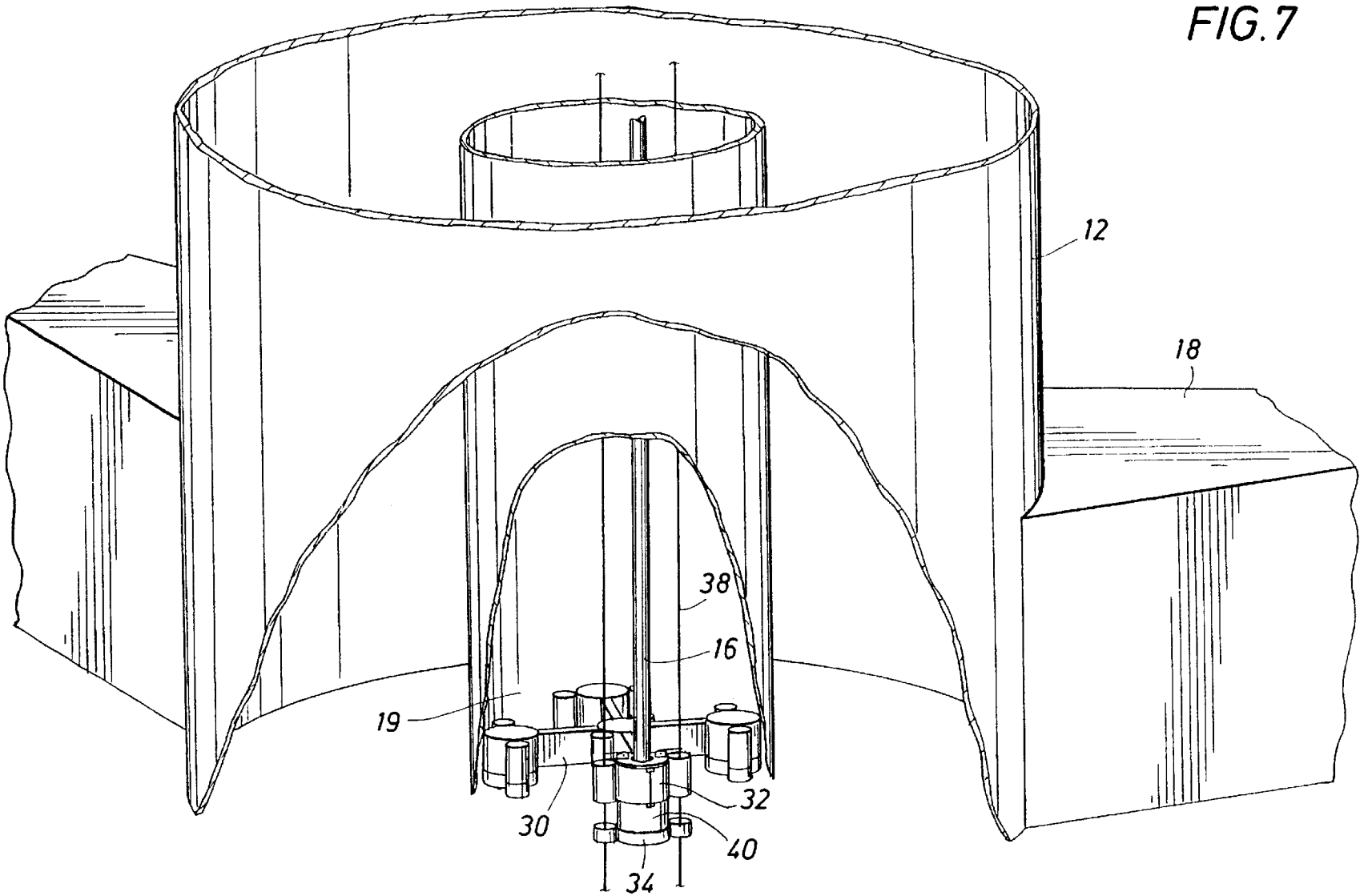
Figure 8:
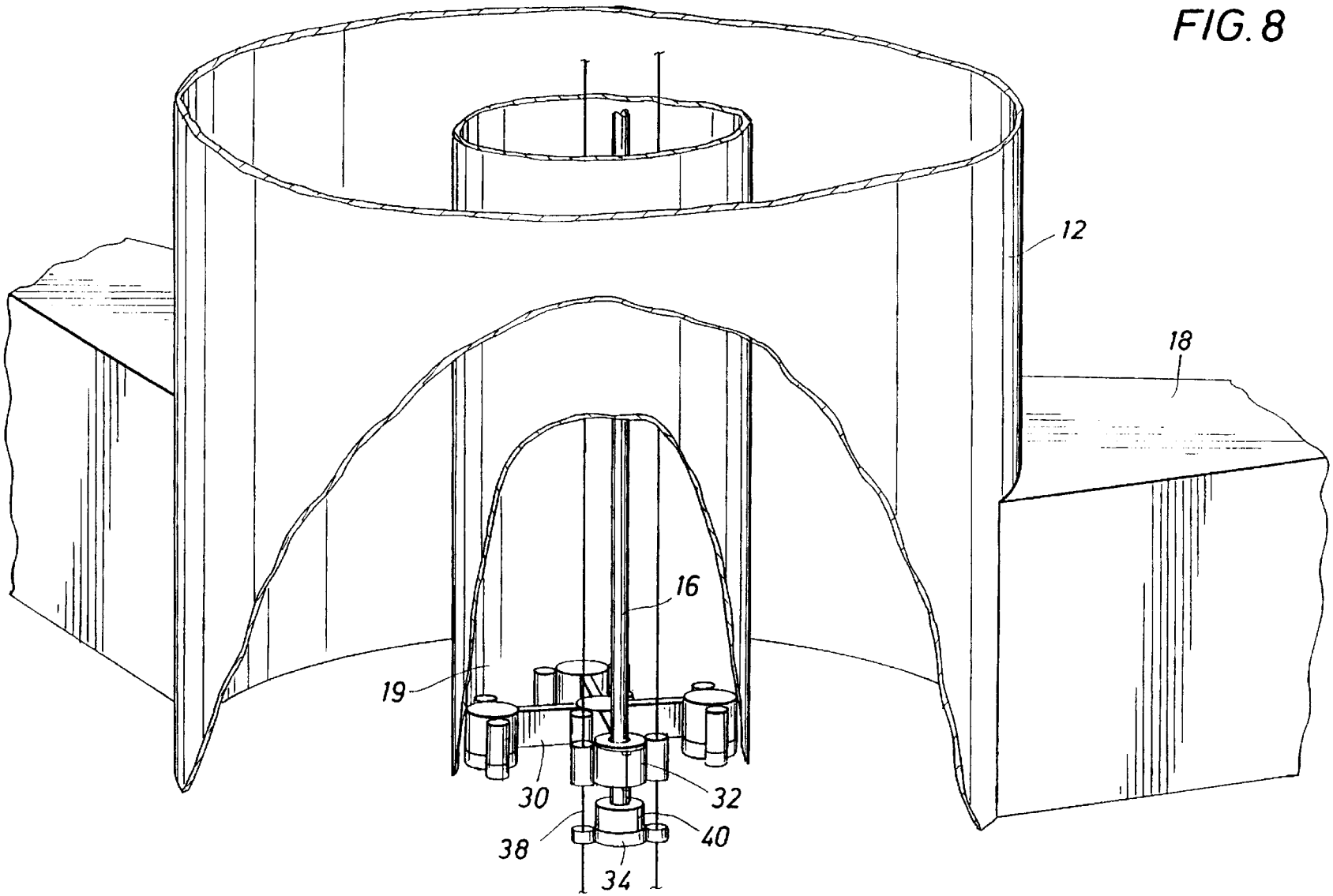
Figure 9:
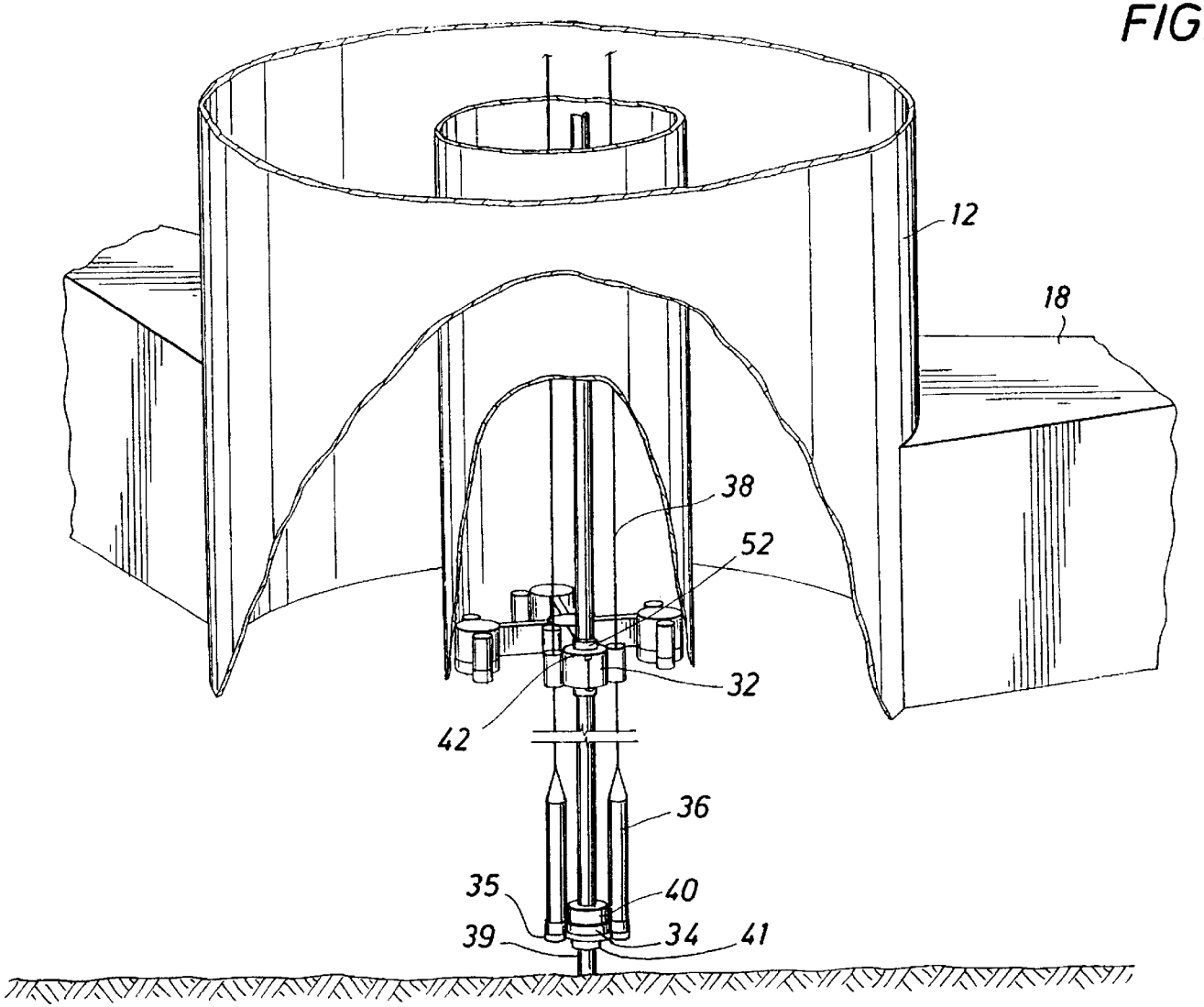

The riser running sequence is illustrated in FIGS. 4–9. In FIG. 4, the loadout position of the riser guides 32 is shown. The guide posts 36 are secured to the lower ends of the guide lines 38 which are connected at the opposite ends thereof to deck-mounted wench mechanisms. The guide posts 36 are initially lowered into the guide tubes 33. For the sake of clarity in the drawings, only one set of guide posts 36 are shown in the running sequence. From the loadout position shown in FIG. 4, the guide posts 36 are lowered through the guide tubes 33, as shown in FIG. 5, to the wellhead 41 mounted on the surface casing 39, as shown in FIG. 9. The guide posts 36 are secured to a guide post connector 35 mounted on the wellhead 41 utilizing ROV (remote operated vehicles) assistance or other conventional means.

Figure 6:
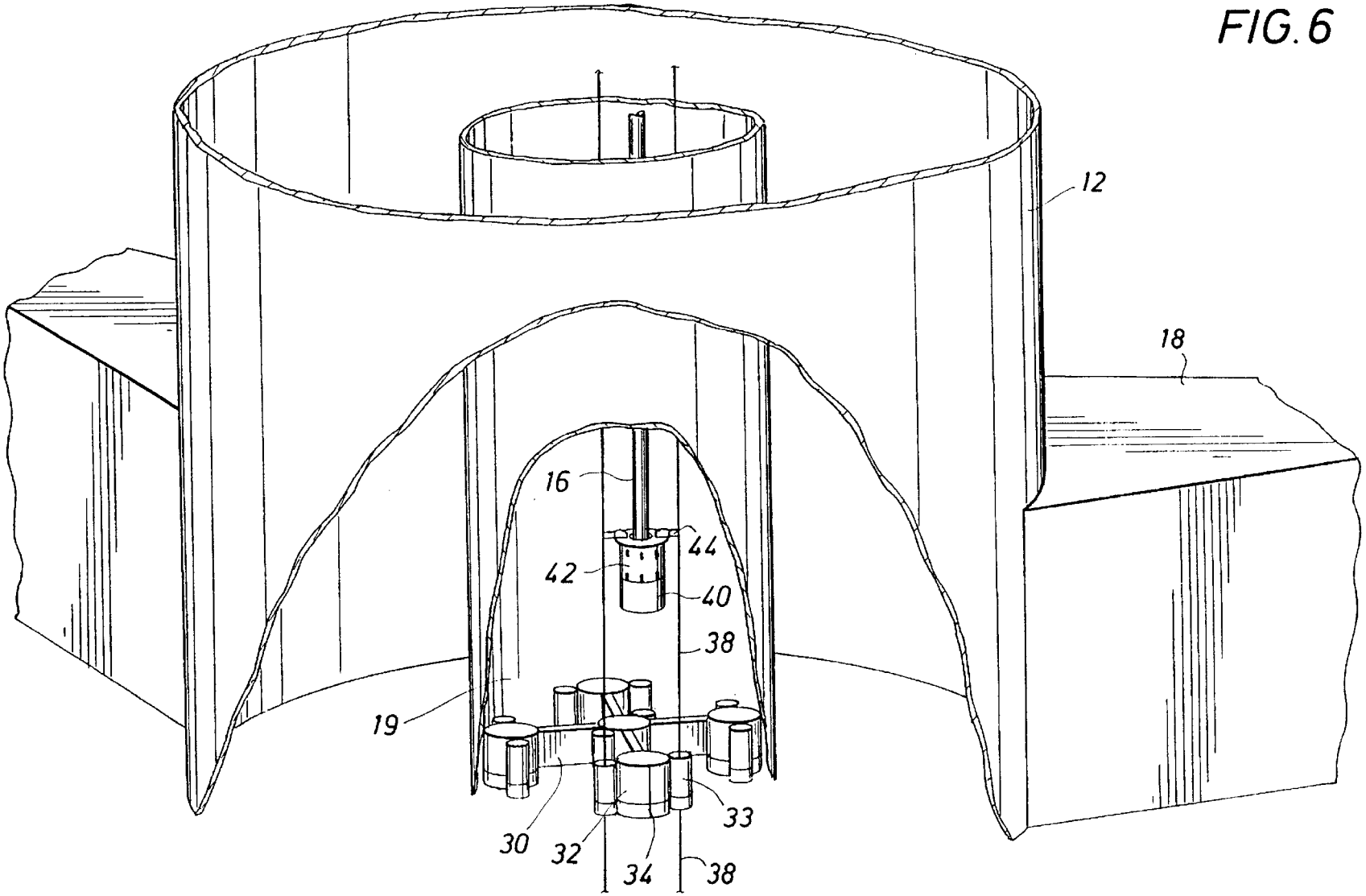

Referring now to FIG. 6, a connector 40 and insert centralizer 42 are mounted on the lower end of the riser 16 and lowered for engagement with the riser guide 32. The centralizer 42 includes sheaves 44 which ride along the guide lines 38 as the connector 40 and centralizer 42 are lowered, and the centralizer 42 is releasably received in the riser guide 32, as shown in FIG. 7.

As the centralizer 42 is fully received in the riser guide 32, the connector 40 advances through the riser guide 32 and engages the guide frame 34. The downward force applied by the connector 40 on the guide frame 34 releases it from the riser guide 32 and attaches the guide frame 34 on the bottom of the connector 40. The riser 16, connector 40 and guide frame 34 are then lowered along the guide lines 38 to the wellhead 41, as shown in the sequence of FIGS. 7–9. As the riser 16 approaches the wellhead 41, the guide frame 34 slides over the guide posts 36 to position the riser 16 for connection to the wellhead 41. At the opposite end of the riser string, an annular collar 52 is mounted on a riser joint 16 which extends through the riser guide 32. The annular collar 52 seats snugly in the centralizer 42 so that the riser string is restrained from lateral movement, but is permitted to move vertically.

Figure 10A:
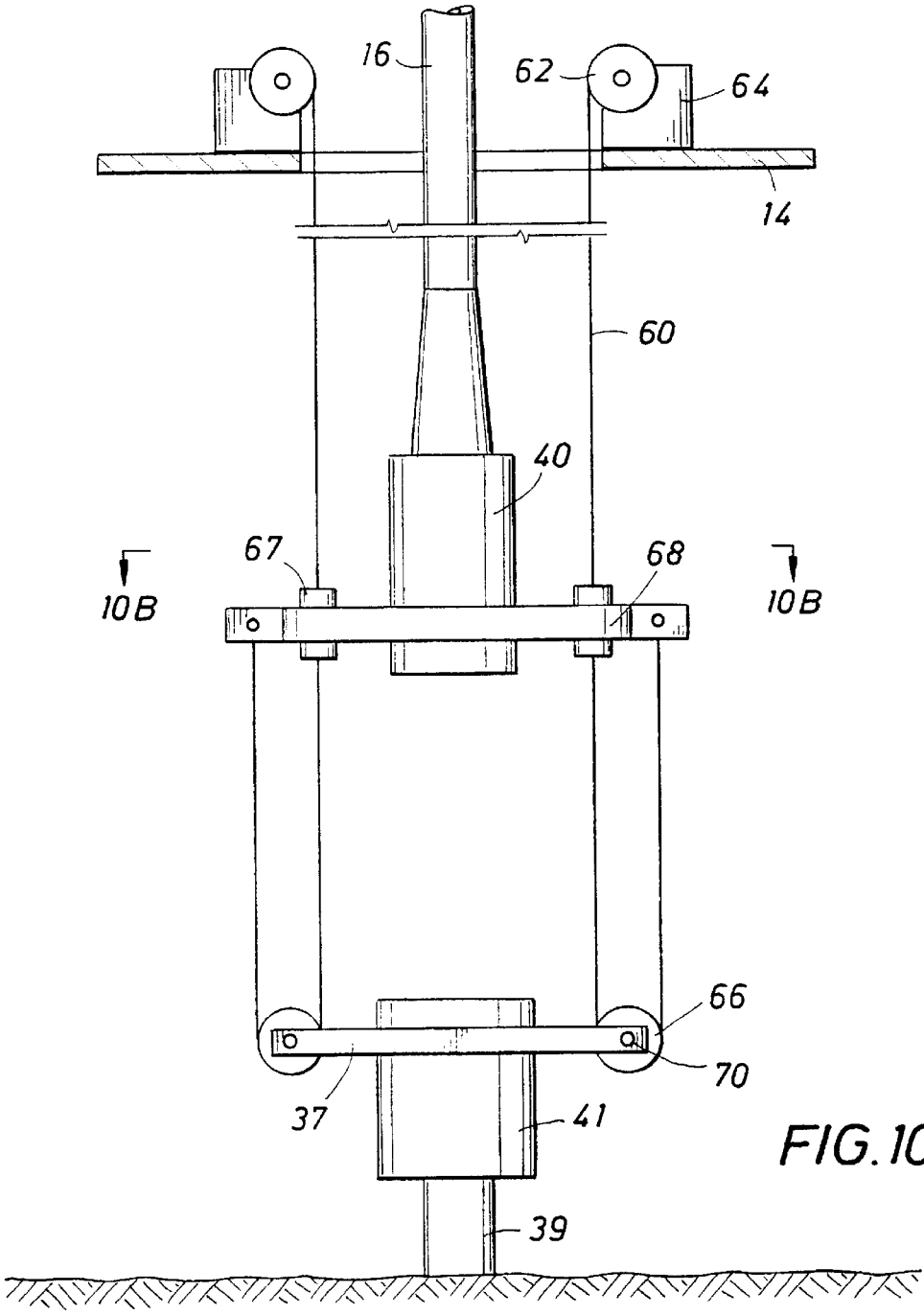
FIG. 10A is a side view of a riser pull-down system which may be employed with the riser lateral restraint system of the invention.
Figure 10B:
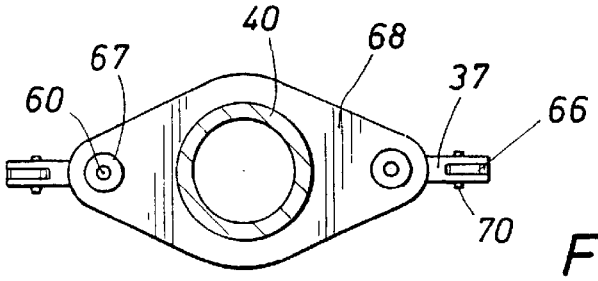
FIG. 10B is a section view taken along line 10B—10B of FIG. 10A.

Referring now to FIGS. 10A and 10B, in some environments, strong currents occur very frequently. The riser pull-down system shown in FIG. 10A may be used with the riser lateral restrain system of the present invention to provide control of current induced deflection of the risers, thereby permitting riser installation to proceed without excessive "waiting on weather." The riser pull-down system shown in FIG. 10A includes guidelines 60 having an end thereof attached to sheaves 62 which in turn are operatively connected to pull down wenches 64 mounted on the platform deck 14. The guidelines 60 extend downward to the wellhead 41, loop about sheaves 66 and then upward to a running connector 68. The distal ends of the guidelines 60 are securely fixed to the running connector 68.

The sheaves 66 are rotatably mounted on opposite ends of the wellhead guidebase 37, which in turn is mounted about the wellhead 41. The sheaves 66 are journalled about pivot rods 70 which secure the sheaves 66 on the guidebase 37. The sheaves 66 freely rotate about the pivot rods 70.

The running connector 68 is firmly engaged about the connector 40 fixed on the end of the riser 16. Guide tubes 67 provide a passageway for the guidelines 60 through the running connector 68.

The riser running sequence when employing the riser pull-down system shown in FIGS. 10A and 10B is similar to the running sequence described herein relating to FIGS. 7–9. The primary differences being that the guide frame 34, guide posts 36 and guide post connector 35 are replaced by the running connector 68, wellhead guidebase 37 and sheaves 66. The riser centralizer 42 is seated in the riser guide 32 as previously described, however the connector 40 attaches to the running connector 68 which is releasably secured to the bottom of the riser guide 32. Thereafter, the deck mounted wenches 62 spool the guidelines 60 upward which in turn pulls down on the running connector 68, thereby pulling the riser 16 and connector 40 downward to the wellhead 41. Tension is maintained on the guidelines 60 so that strong subsea currents are unable to significantly deflect the riser string as it is lowered for connection to the wellhead 41.

The foregoing disclosure and description of the invention are illustrative and explanatory thereof, and various changes in the invention may be made within the scope of the appended claims without departing from the spirit of the invention. Thus, by way of example rather than limitation, while the invention has been described for a cylindrical central column having a cylindrical moonpool axially extending through the column, it may also be employed to advantage in connection with n-sided columnar structures and n-sided moonpool configurations in cross section . Thus, a square axially extending moonpool is well within the scope of the present invention. Similarly, other and further embodiments of the invention may be devised without departing from the basic scope thereof, and the scope thereof is determined by the claims which follow.

What is claimed is:

1. A floating platform comprising:

(a) a hull having a central columnar structure supporting one or more decks in a body of water above the water line, said columnar structure including a moonpool extending through said columnar structure;

(b) anchor means securing said hull to a seabed below the water line;

(c) well risers extending through said moonpool;

(d) lateral restraint means secured within said moonpool for laterally restraining said well risers, said lateral restraint means including a plurality of riser guides secured in said moonpool averse to the longitudinal axis of said columnar structure; and (e) lower guide members releasably secured to said riser guides.

2. The platform of claim 1 wherein said columnar structure includes an upper end extending above the water line.

3. The platform of claim 1 including a reduced diameter column extending vertically from an upper end of said columnar structure.

4. The platform of claim 1 including guidelines connected to guide posts at the lower ends thereof, said guide posts being adapted for connection to a wellhead guidebase.

5. The platform of claim 1 including a riser pull-down assembly for guiding said well risers through the body of water for connection to a wellhead located in the body of water.

6. The platform of claim 1 including tension means for maintaining said well risers under tension.

7. A system for laterally restraining well risers and minimizing the spacing between the well risers extending through a moonpool of a floating platform, comprising:

(a) one or more riser guides secured in said moonpool transverse to the longitudinal axis of said moonpool;

(b) a plurality of frame members interconnecting said riser guides, said frame members maintaining the spacing between said riser guides; and (c) lower guide members releasably secured to said riser guides.

8. The system of claim 7 wherein said riser guides are open ended receptacles defining a substantially cylindrical body having guide tubes mounted on opposite sides of said cylindrical body.

9. The system of claim 8 including a centralizer and annular collar mounted within said cylindrical body for laterally restraining a riser extending through said cylindrical body while permitting vertical movement of said riser.

10. The system of claim 7 including guide posts suspended from guide lines extending from the floating platform, said guide posts being received within said guide tubes in a first position and adapted for connection to a wellhead guidebase in a second position.

* * * * *